US005301945A

United States Patent [19]

Schmidt et al.

[11] Patent Number: 5,301,945

[45] Date of Patent: * Apr. 12, 1994

[54] HOLLOW, METALLIC GOLF CLUB HEAD WITH RELIEVED SOLE AND DENDRITIC STRUCTURE

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The portion of the term of this patent subsequent to Aug. 27, 2008 has been disclaimed.

[21] Appl. No.: 29,553

[22] Filed: Mar. 11, 1993

Related U.S. Application Data

[63] Continuation of Ser. No. 819,379, Jan. 15, 1992, Pat. No. 5,240,252, which is a continuation-in-part of Ser. No. 791,322, Nov. 14, 1991, Pat. No. 5,180,166, which is a continuation of Ser. No. 595,963, Oct. 16, 1990, Pat. No. 5,067,715.

[51] Int. Cl.[5] ..... A63B 53/04

[52] U.S. Cl. ..... 273/167 A; 273/174

[58] Field of Search ..... 273/167 A–167 E, 273/167 G, 167 H, 167 K, 172, 174, 167 F

[56] References Cited

U.S. PATENT DOCUMENTS

| | | | |
|---|---|---|---|
| D. 94,549 | 2/1935 | Jansky . | |
| D. 225,419 | 12/1972 | Mills . | |
| D. 307,783 | 5/1990 | Iinuma . | |
| D. 318,087 | 7/1991 | Helmstetter . | |
| 1,568,888 | 1/1926 | Dunn . | |
| 1,619,566 | 3/1927 | Crankshaw . | |
| 1,658,581 | 2/1928 | Tobia . | |
| 1,669,482 | 5/1928 | Miller . | |
| 2,041,676 | 5/1936 | Gallagher . | |
| 2,087,685 | 7/1937 | Hackney . | |
| 2,201,638 | 5/1940 | Theibault, Sr. . | |
| 2,460,435 | 2/1949 | Schaffer . | |
| 2,960,338 | 11/1960 | Havey et al. . | |
| 3,761,095 | 9/1973 | Thompson . | |
| 4,214,754 | 7/1980 | Zebelean . | |
| 4,332,388 | 6/1982 | Crow . | |
| 4,432,549 | 2/1984 | Zebelean . | |
| 4,511,145 | 4/1985 | Schmidt . | |
| 4,872,685 | 10/1989 | Sun . | |
| 4,930,781 | 6/1990 | Allen . | |
| 5,042,806 | 8/1991 | Helmstetter . | |
| 5,067,715 | 11/1991 | Schmidt et al. . | |
| 5,180,166 | 1/1993 | Schmidt et al. | 273/167 H |
| 5,240,252 | 8/1993 | Schmidt et al. | 273/167 A |

FOREIGN PATENT DOCUMENTS

| | | |
|---|---|---|
| 2225726 | of 0000 | United Kingdom . |
| 1476889 | 6/1977 | United Kingdom . |
| 2100993 | 1/1983 | United Kingdom . |
| 2230459 | 10/1990 | United Kingdom . |

*Primary Examiner*—Vincent Millin
*Assistant Examiner*—Steven B. Wong
*Attorney, Agent, or Firm*—William W. Haefliger

[57] ABSTRACT

A golf club head comprising toe and heel portions, a front wall defining a ball-striking face, and top and bottom walls, the bottom wall characterized as having a medial ridge, and as forming two shallow recesses, one recess between the ridge and the heel portion, and the other recess between the ridge and the toe portion, the recesses everywhere spaced rearwardly from the front wall, the one recess having an arcuate peripheral edge generally convex toward the heel portion, and the other recess having an arcuate peripheral edge generally convex toward the toe portion.

28 Claims, 4 Drawing Sheets

HOLLOW, METALLIC GOLF CLUB HEAD WITH RELIEVED SOLE AND DENDRITIC STRUCTURE

BACKGROUND OF THE INVENTION

This application is a continuation of Ser. No. 819,379 filed Jan. 15, 1992, now U.S. Pat. No. 5,240,252 issued Aug. 31, 1993, which is a continuation-in-part of Ser. No. 791,322 filed Nov. 14, 1991, now U.S. Pat. No. 5,180,166 issued Jan. 19, 1993, which is a continuation of Ser. No. 595,963 filed Oct. 16, 1990, now U.S. Pat. No. 5,067,715 issued Nov. 26, 1991.

This invention relates generally to increasing the size of metallic, hollow golf club heads (woods) without increasing head weight. More particularly, it concerns the distribution of ball impact waves from the head front wall in such manner as to resist deflection of that front wall and to absorb such shock waves on top, bottom, and rear walls.

Large, very thin-walled, metal golf club heads present the problems of cracking and buckling of metal walls, and excessive front wall deflection, during ball impact. There is need to alter the manner in which shock waves are distributed within metal wood walls, as by providing a mechanism which guides, interrupts, spreads, or otherwise alters the shock waves which emanate from the face at impact, but while maintaining optimum wall thicknesses.

There is also need to strengthen the thinned bottom walls, or sole plates, of such golf club heads, as well as to reduce drag forces at such bottom walls during stroking.

SUMMARY OF THE INVENTION

It is a major object of the invention to provide structure overcoming the above problems and disadvantages. Basically, the improved head of the invention is characterized by a ball striking front wall, a bottom wall, and spaced toe and heel walls, the bottom wall characterized as having two shallow recesses, one recess closer to the heel portion, and the other recess closer to the toe portion, the recesses being everywhere spaced rearwardly from the front wall, the one recess having an arcuate peripheral edge generally convex toward the heel portion, and the other recess having an arcuate peripheral edge generally convex toward the toe portion.

Such recesses typically have downward facing surfaces with shallow upwardly dished configuration. The downward facing surfaces are concave in front-to-rear directions; and the downward facing surfaces are also concave in directions between the heel and toe.

Another object is to provide a bottom wall structure that will aid in "digging out" a golf ball having a bad lie.

Another object is to provide such a head wherein the bottom wall has a locally flattened, rearwardly divergent surface that extends at a rearwardly and upwardly extending angle, beyond rearward extent of a medial ridge, and between rearward extents of the recesses. That flattened surface may merge with peripheries of the dished recesses, as will appear.

A further object is to provide the bottom wall to be in part defined by a sole plate having a peripheral edge rigidly connected to the bounding edge of an opening defined by the bottom wall, rearwardly of the front wall, whereby the sole plate closes the opening, the medial ridge and recesses also being in part defined by the sole plate. In this regard, the sole plate typically defines major extents of the shallow recesses. A head body shell may also define a rigidizing bottom wall corner plate section integral with shaft supporting tube structure, the sole plate also connected to that corner plate section, the corner plate section also forming a portion of the one shallow recess closest to the head heel portion.

Yet another object is to provide a first group of narrow, metallic, shock wave distributing dendrites extending from the front wall generally rearwardly adjacent the underside of the shell top wall and integral therewith, the dendrites projecting toward the two shallow recesses, the bottom wall defining those recesses being upwardly concave toward the dendrites.

A second group of dendrites may also be provided to be integral with the top wall and spaced apart to extend generally rearwardly to merge rearwardly and downwardly with a rear wall defined by the shell to transfer rearward loading to that wall was the dendrites pick up rearward loading from the top wall in response to front wall impact with a golf ball, the second group of dendrites also projecting toward the two shallow recesses.

The dendrites are such as to transfer, spread, dampen, and distribute impact-produced shock so as to reduce shock wave concentration otherwise imposed on the junction between the front wall and top wall. Shock waves are produced by high speed impact of the club head with the golf ball which leaves the head only ½ millisecond after impact, for a driver with head traveling at 100 miles per hour. The dished walls of the plate also strengthen the structure for shock load transmission.

It is another object to provide hosel structure that extends downwardly into the head interior and forms a shaft-receiving opening. This strengthens the connection of the front wall to the dished sole plate and heel, and reduces hosel weight, so that such weight can be utilized to form the dendrites, as referred to. In this regard, the invention enables the provision of a larger overall volume head, as compared with the head of the same weight, but lacking the dendritic structure, as referred to. As will be seen, the use of such structure enables thinning of the hollow head top, toe, back, and heel walls.

Another object is to provide a head bottom wall which controls engaged turf relative movement (during a golf swing) so as to create upward force or force acting on the head in a manner resulting in reduced drag as the head is swung.

These and other objects and advantages of the invention, as well as the details of an illustrative embodiment, will be more fully understood from the following specification and drawings, in which:

DRAWING DESCRIPTION

DETAILED DESCRIPTION

Figure 1:
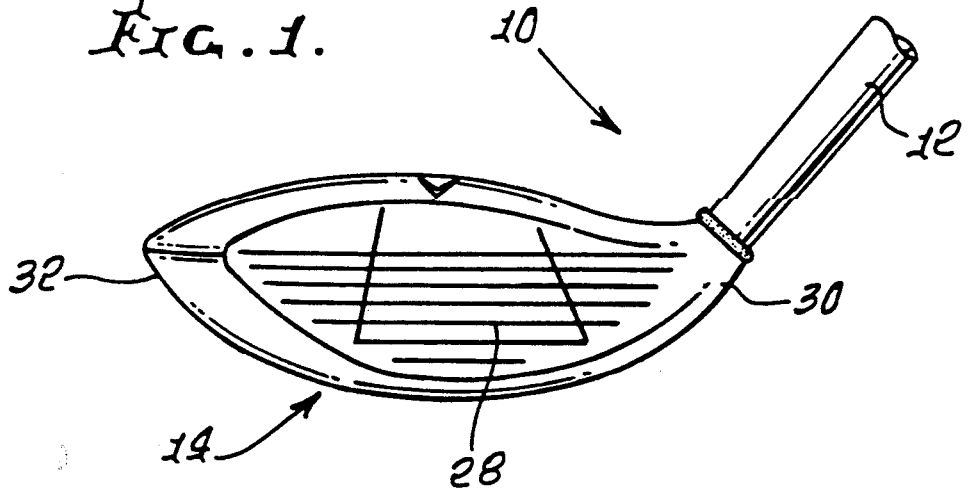
FIG. 1 is a front elevational view of a golf club head incorporating the invention.

Referring now to the drawings, a golf club 10, in accordance with a preferred embodiment of the present invention, is shown. The club 10 includes a shaft 12 (only the lower portion of which is shown), which is attached to a head 14. The head 14 is in the configuration of a "wood" club, although it is made of metal. As shown in FIGS. 5–8, the head comprises a hollow metal shell 16, which is filled with a plastic foam filling 18, preferably polyurethane.

The shell 16 is preferably made of stainless steel, and it may be fabricated by the "lost wax" casting method that is well-known in the art. The shell 16 is formed in two pieces: a main portion 20 and a sole plate 22 that is peripherally welded to the main portion 20, and as will be referred to.

Figure 2:
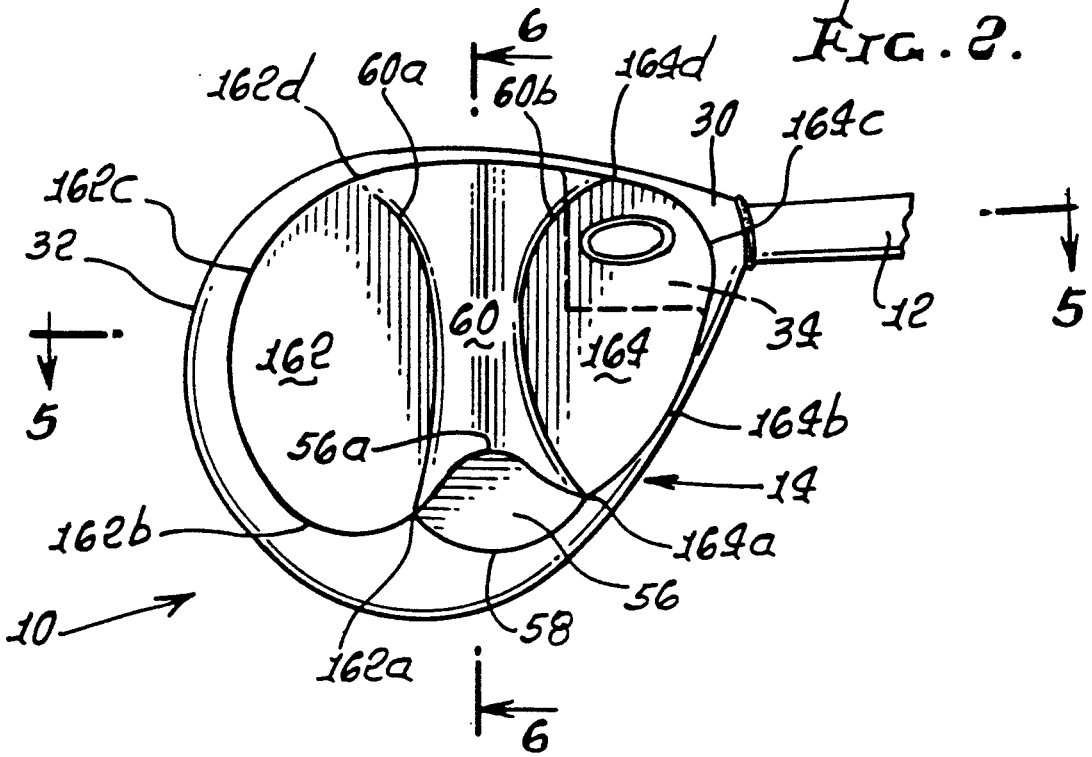
FIG. 2 is a plan view of the bottom of the FIG. 1 head.

The main shell portion 20 has a top surface 24, a rear surface 26, and a ball-striking surface or face 28 opposite the rear surface 26. The face 28 is angled with respect to the vertical with a specified "pitch" that is determined by the type of club and the amount of loft desired. The end portion of the head 14 proximate the shaft 12 is commonly termed the "heel" 30, while the end portion opposite the heel 30 is termed the "toe" 32. As shown in FIG. 2, the face 28 is typically curved from the heel 30 to the toe 32. The main shell portion 20 has a bottom corner portion 34 (shown in FIG. 10) that is cast integrally with the front wall **28*a* and with the heel wall 30*a*, and flush with the sole plate 22, and that forms a bottom surface or sole in combination with the sole plate 22** when the two shell portions are welded together.

Figure 5:
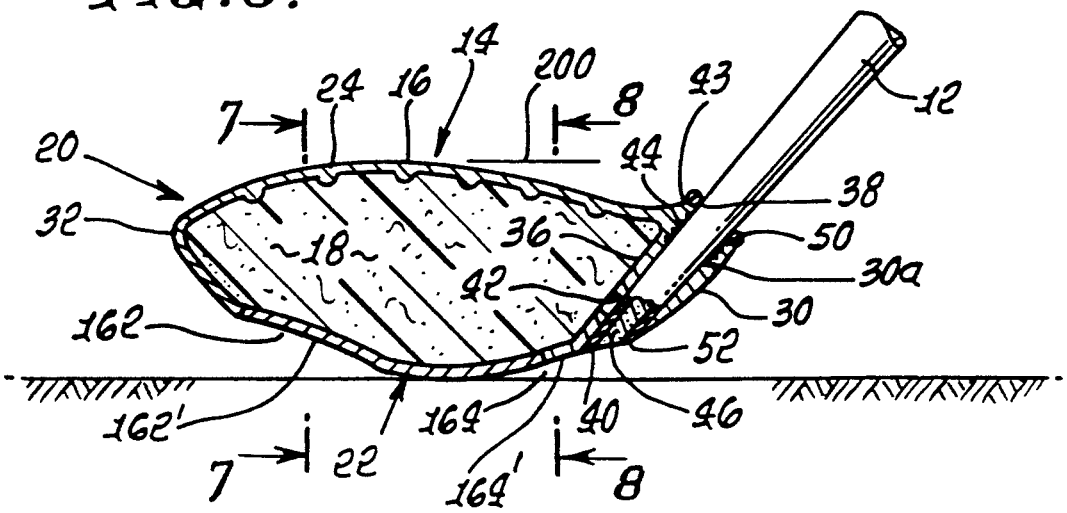
FIG. 5 is an elevation taken in section on lines 5—5 of FIG. 2.
Figure 6:
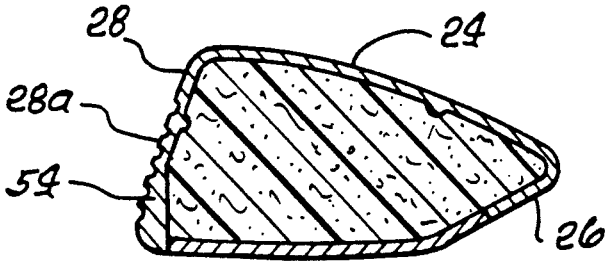
FIG. 6 is an elevation taken in section on lines 6—6 of FIG. 2.
Figure 7:
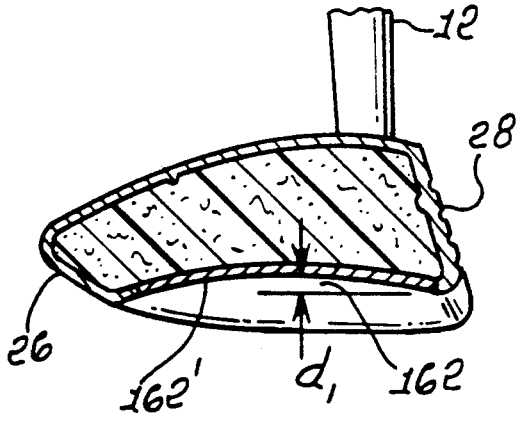
FIG. 7 is an elevation taken in section on lines 7—7 of FIG. 5.
Figure 8:
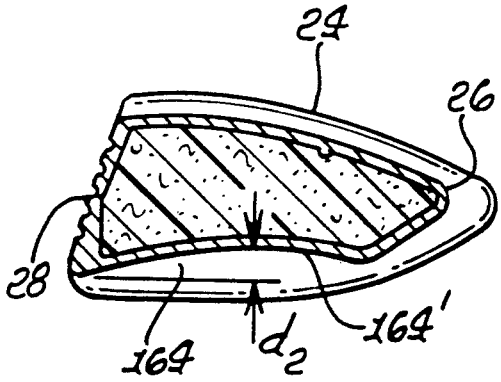
FIG. 8 is an elevation taken in section on lines 8—8 of FIG. 5.
Figure 9:
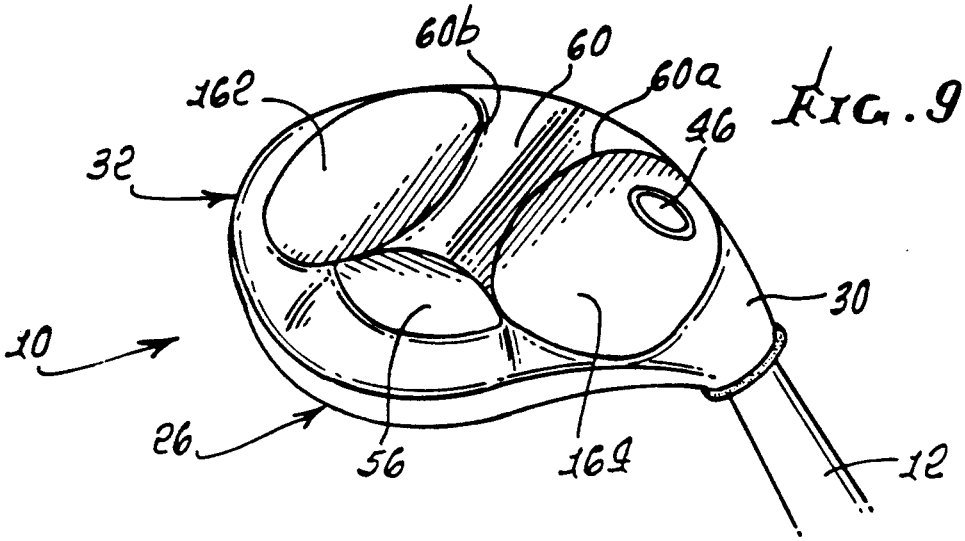
FIG. 9 is a perspective view showing the bottom, rear, and heel end of the FIG. 1 club head.

Referring now to FIG. 5, the heel wall **30*a* of the shell 16 is provided with a substantially continuous hollow tube 36 that extends from an upper opening 38 in the top surface 24 to a lower opening 40 in the bottom surface or sole through the bottom corner portion 34 of the main shell portion 20. The tube 36 is of substantially uniform internal diameter, and its side wall is interrupted by an internal orifice 42 that opens into the interior of the shell. The orifice 42 provides an entrance for the introduction of the foam material 18** into the shell interior during the manufacturing process.

Figure 3:
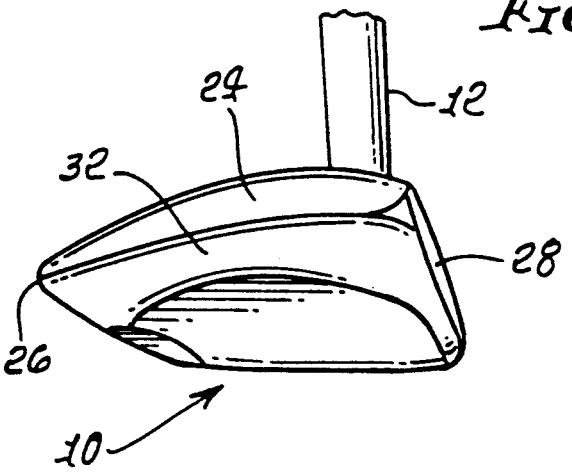
FIG. 3 is an elevational view of the toe end of the FIG. 1 head.

The tube 36 is dimensioned to receive the lower part of the shaft 12 with a snug fit. The upper opening 38 is provided with a radiused lip 43, as shown in FIG. 3, to minimize the possibility of stress fractures in the shaft due to impact against the edge of the opening. A portion of the interior wall of the tube 36, extending downwardly from the upper opening 38, may be provided with striations, preferably in the form of internal threads, or a series of concentric steps 44, to provide a "glue lock" for better bonding of the shaft in the tube.

In the preferred embodiment of the invention, the lip 43 is at the end of a slight rise at the heel end of the head, the height of the rise being less than, or approximately equal to, the height of a horizontal plane 200 defined by the highest point of the club head top surface 24.

The shaft 12 is a hollow tube made of any suitable material. Steel is the most common material, but titanium and graphite-boron may also be used. If the shaft is of steel, the exterior of the shaft may be chrome-plated to minimize corrosion. The lower part of the shaft may be fitted with a plug 46 to prevent the entry of moisture into the interior of the shaft. The plug 46 may be of any suitable resilient material, such as Nylon, epoxy, polyurethane, or Delrin. The plug 46 may be retained in the shaft by an annular crimp in the shaft wall. The crimp also serves as a glue lock. A locator ring 50, preferably of glass fiber-reinforced nylon, is adhesively bonded to the shaft at a distance above the bottom end 52 of the shaft approximately equal to the length of the tube 36.

Figure 4:
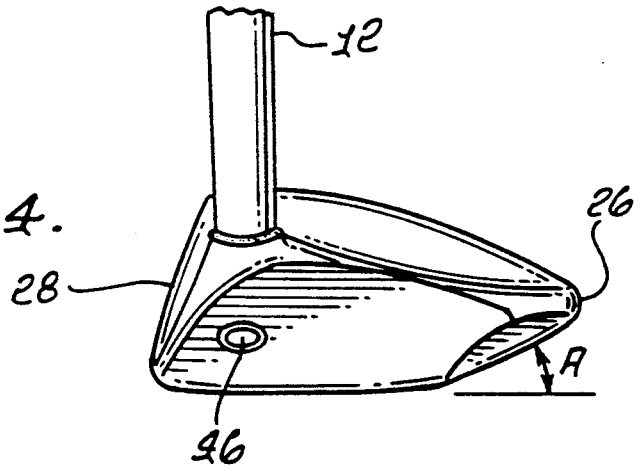
FIG. 4 is an elevational view of the heel end of the FIG. 1 head.

The shaft 12 may be attached to the head 14 by a suitable epoxy adhesive, the steps or threads 44 in the tube 36 and the crimp 48 in the shaft providing "glue locks", as mentioned above, for better adhesive bonding. (Any plating on the lower part of the shaft is first buffed off.) During assembly, the lower part of the shaft is inserted into the tube 36 until the locator ring 50 abuts against the radiused lip 43 at the upper tube opening 38. The bottom end 52 of the shaft 12 then extends slightly beyond the lower tube opening 40. This bottom end 52 is then cut and ground so as to be flush with the sole of the head, as shown in FIGS. 4 and 5.

The structure described above allows the shaft to be attached to the head without a neck or hosel. As a result, substantially all of the mass of the head is "effective mass" that contributes to the transfer of energy from the player to the ball, with little or no "deadweight" to reduce the attainable club head velocity. By increasing the effective mass of the club head without reducing the attainable velocity, there is a more effective transfer of energy to the ball from the player, yielding increased shot distance without an increase in effort on the part of the player.

Moreover, without a hosel, the lower part of the shaft extends all the way through the head, with the bottom end 52 of the shaft terminating flush with the sole. Thus, by eliminating the hosel, the shaft both enters and exits the head within the area defined between the top and bottom of the face of the club head, which area is sometimes called the "ball control zone". By bringing the lower end of the shaft within the control zone, and extending the shaft through to the sole of the club head, the tactile sense of the location of the club face, or "head feel", is maximized, yielding increased control of the shot, greater ability of the skilled player to "work" the ball, and a more solid feel of impact with the ball regardless of where on the face the ball is struck. The increase in effective mass of the club head, plus the rigid support for the lower end of the shaft, provided by the internal tube 36 in which the lower end of the shaft is received, further contribute to this improvement in "head feel".

Furthermore, a number of advantages in the manufacturing process can be achieved by eliminating the hosel. For example, the mass that would have been taken up by the hosel can be redistributed to a part of the club head where it can contribute to the effective mass of the head without increasing the total head mass. Optimally, this mass can be added by increasing the overall size of the club head.

Still another advantage of eliminating the hosel is that there is a more even cooling of the club head in the mold. Where there is an upward hosel, by comparison, the hosel and the rest of the club head shell may cool at unequal rates, thereby resulting in a slight warping that can produce a lack of uniformity in loft, lie, and face angle from club head to club head.

A golf club, in accordance with a preferred embodiment of the invention, includes the sole configuration shown in the drawings.

As shown in the drawings, the bottom wall is characterized as forming a medial ridge 60, and as forming two shallow recesses, one recess between the ridge and the heel portion, and the other recess between the ridge and the toe portion, the recesses everywhere spaced rearwardly from the front wall, the one recess having an arcuate peripheral edge generally convex toward the heel portion, and the other recess having an arcuate peripheral edge generally convex toward the toe portion. Examples of such shallow, upwardly dished recesses are seen at 162 between the ridge 60 and the toe 32, and at 164 between the ridge and heel 30.

Recess 162 curved periphery, which extends in a looping edge path, indicated at 162*a*, 162*b*, 162*c*, and 162*d*, and recess 164 also extends in a looping edge path indicated at 164*a*, 164*b*, 164*c*, and 164*d*, both paths located on the bottom wall, as shown. The maximum depth of each recess below a plane containing its peripheral looping edge path is less than ¼ inch, and preferably between 1/16 inch and 3/16 inch. See depths $d_1$ and $d_2$ in FIGS. 7 and 8. These depths are sufficient to avoid direct frictional contact of recess dished inner surfaces 162' and 164' with the ground during a club stroke, ground contact, if any, being confined to the lowermost extent of the central ridge 60. Also, the upward bidirectional concavity of the bottom wall extents 162' and 164' forming the recesses adds to bottom wall strength, and stiffness, for transmitting shock loading transmitted to and from the front wall 28 during ball stroking. The bottom wall thickness may then be minimized and metal "redistributed" to enable provision of a larger sized head.

Note also the provision of a bottom wall locally flattened, rearwardly divergent surface that extends at a rearwardly and upwardly extending angle, beyond rearward extent of the ridge, and between rearward extents of the recesses.

Specifically, there is a trailing edge, flat 56, which is a relieved, upwardly angled, flattened portion extending upwardly from a curved edge 56*a* and between that edge and the center of the sole and a trailing edge 58 at the juncture between the rear surface 26 of the club head and the sole plate 22. The lowermost curved part 56*a* of the trailing edge flat 56 is contiguous with the rearward end of ridge 60 that extends forward toward and diverges at 60*a* and 60*b* to merge laterally with the bottom U-shaped edge of the face 28 of the club head.

The trailing edge flat 56 is preferably at an angle A of approximately 18° with respect to the horizontal. The angle A may be varied by plus or minus up to 5 degrees, depending on the type of club and the preference of the player. The trailing edge flat 56 minimizes the club head's closing, or "hooding", when the ball is hit "fat", while reducing the overall aerodynamic drag of the club head to maximize its attainable velocity during the swing.

Further, in regard to the described combination of bottom wall contours, the ridge downward curvature rearwardly of the front face, and between the dished recesses 162 and 164 enables the sole to penetrate the turf, resisting and repelling the turf against the dished out zones 162 and 164 to limit penetration in proportion to or accordance with the unique shape of the sole as a unit, in a unique way, the front face having a downward U-shape forward of the recesses and ridge, as is clear from FIGS. 1 and 2. Note the ridge diverging forwardly toward the U-shaped front face.

Accordingly, a golf ball having a "bad lie" can be approached in a confident way, to "dig" the ball out by means of a club stroke characterized in that the club head sole planes over the turf, considering the turf as fluid. For a golf ball having a more conventional lie, no "digging out" is required, and an improved downward sole shape "footprint" is produced on the turf, as will be referred to.

Figure 10:
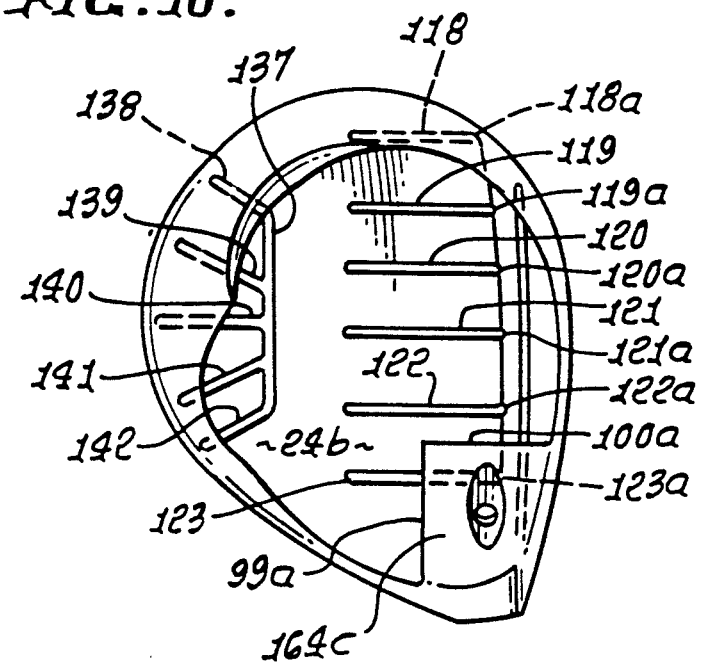
FIG. 10 is a plan view showing the bottom of the FIG. 1 head, but prior to attachment of a sole plate.
Figure 11:
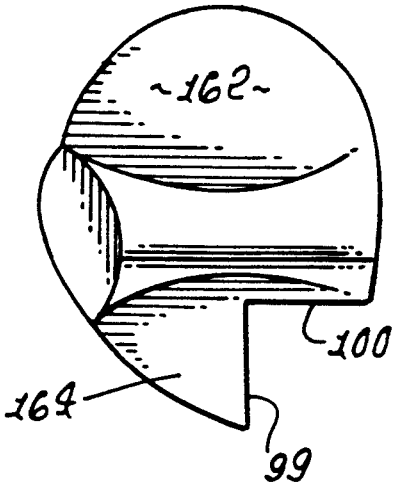
FIG. 11 is a plan view of the sole plate that fits into the bottom opening shown in FIG. 10.

Referring to FIGS. 5, 10, and 11, hosel tube 36 extends downwardly into the hollow interior of the heel portion of the head, and is adapted to receive a shaft 12. Thus, the weight of the hosel is concentrated more directly behind, or close to, the rear side of front wall 28, near the heel, to contribute to the ball-striking mass of the front wall. Also, the hosel cylindrical wall reinforces the junction of the front wall, bottom wall, and heel wall. See also rigidizing hosel webbing or filleting 34 which forms the corner plate section of the bottom wall 22. Corner section also forms a portion of the dished portion of the bottom wall recess 164. When the sole plate is attached to the shell, a weld may be formed along edges 99 and 99*a*, and 100 and 100*a*. See FIGS. 10 and 11.

In accordance with another important aspect of the invention, a first group or set of narrow, metallic dendrites is provided to extend from the front wall 28 generally rearwardly adjacent the underside 24*b* of the top and upper wall 24*a*, and integral therewith. See, in the example, dendrites 118–123 spaced apart in a transverse direction indicated by arrows 120, the dendrites having forward ends 118*a*–123*a* merging into the front wall at its junctions with the top wall. Note the possible widening of the dendrites as they merge with front wall 28. This serves the purpose of distributing impact-produced shock waves from the front wall to the top wall, especially when a ball is hit high on the front wall or face. This in turn serves to prevent cracking and buckling of the thin metal top wall 24. Note that the dendrites are spaced apart, i.e., branch, at intervals of about ½ to ¾ inch; and that the rearward ends of the dendrites are transversely spaced apart.

Figure 12:
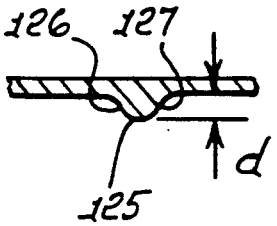
FIG. 12 is a fragmentary section showing dendrite structure.

The vertical dimension "$d_3$" of the dendrites lies within the range 0.050 to 0.070 inch; and the dendrites are generally convex at 125 toward the interior of the head, along their lengths, and have concave opposite sides at 126 and 127 (see FIG. 12). In this regard, and as referred to above, the thickness of the front wall is typically substantially greater than the thickness of the other walls, to strengthen it and prevent cracking under high impact loads. Typical wall approximate thicknesses are: front wall 0.120 inches (maximum), sole plate 0.050 inches (maximum), excluding possible local thickening projecting from front face intersection with the sole plate, and top wall 0.030 inches. The dimensions are less than standard thicknesses, allowing for a larger head and a larger moment of inertia for a given total weight. This in turn allows a greater "forgiveness effect" as regards off-center ball strikes.

Figure 13:
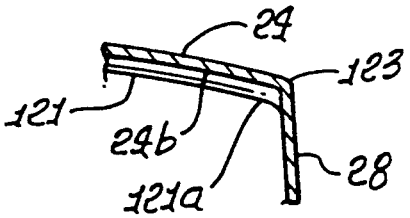
FIG. 13 is a fragmentary section showing dendrites extending rearwardly from the head front wall.

Further, the conformation of the dendrites 118–123 (see FIG. 13) along their lengths, to head interior wall shape, contributes to shock wave distribution across the upper wall 14. Note that wall 14 may be upwardly crowned, i.e., upwardly shallowly convex.

Also provided is a second set or group of narrow, metallic dendrites extending generally rearwardly adjacent the underside of the top wall and integral therewith, the second set also including a transversely extending dendrite intersecting the generally rearwardly extending dendrites of the second set. The dendrites of the second set are located further from the head front wall than the first set of dendrites, the rearwardly extending dendrites of the second set being spaced apart, or branching, in transverse direction, the vertical dimensions of the second set dendrites also being between 0.050 and 0.100 inches. See for example the five dendrites 138–142 that have fan configuration, radiating rearwardly from different points along the single dendrite 137 spaced rearwardly from dendrites 118–123.

Figure 14:
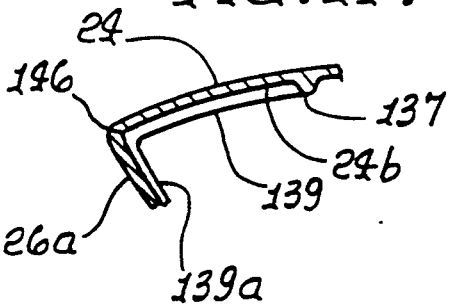
FIG. 14 is a fragmentary section showing dendrites extending rearwardly downwardly adjacent the top and rear walls of the head.

Dendrites 138–142 extend generally rearward to merge with the generally curved rear wall **26*a* of the head, to direct or transfer such rearward loading to that wall as the dendrites pick up loading from top wall 24*a*. See FIG. 14**.

Dendrites 137–142 have generally the same configuration and dimensions as dendrites 118–123. Accordingly, they serve the same shock wave transfer distributing functions to minimize cracking and buckling of the thinned top wall at its junction at 146 with the rear wall. Note also that dendrites 137–142 conform to top wall shape along their lengths. See FIG. 14. In addition, the rearward ends of the dendrites 137–142 turn downwardly adjacent the inner side of rear wall **26*a*, as seen at 139*a* in FIG. 14**, for example.

The dendrites project generally toward the upwardly dished walls 162' and 164', so that both top and bottom walls are stiffened to transmit shock loading rearwardly, whether the ball strikes the front wall 28 relatively upwardly thereon, or at a lower portion thereof.

A further important aspect of the invention concerns the provision of a golf club head having a metal shell defining top, bottom, front, rear, toe, and heel walls, and wherein:

a) the bottom wall has upwardly dished wall extent, b) said upwardly dished wall extent defining downward facing surface means inclined forwardly and upwardly relative to the head swing path as the bottom wall engages the turf, so that the turf moving relatively rearwardly engages said inclined surface means for creating lift force acting to urge the bottom wall and the head in an upward direction, whereby drag is reduced and more kinetic energy is available for transfer to the ball.

Further, and as described, the bottom wall also has a downward facing medial ridge 60 which extends generally forwardly, said dished wall extent preferably including two dished extents 162 and 164, respectively, located at opposite sides of said ridge, each of said two dished extents defining a portion of said inclined surface means whereby upward lift forces are developed at opposite sides of said ridge, for torsionally balanced upward lift imparted to the head.

Finally, the turf controlling head bottom wall can be formed or cast integrally with the remainder of the head, if desired, i.e., it need not be separately formed and later welded to a rim defined by a separately cast head. Such forming may be by a casting or molding process employing metallic or nonmetallic material.

The bottom wall and/or the rest of the head can be made of materials other than metal.

As used herein, the word "turf" shall be understood to mean grass, weeds, sand, mud, and other material engageable and displaceable by the bottom wall of the head.

We claim:

1. In a golf club head having a shell and defining top, bottom, front, rear, toe and heel walls, and a shell interior, the combination that includes:

a) the bottom wall having upwardly dished wall extent, b) said upwardly dished wall extent having downwardly facing surface means inclined forwardly and upwardly relative to the head swing path as the bottom wall engages the turf, so that the turf moving relatively rearwardly engages said inclined surface means for creating lift force acting to urge the bottom wall and the head in an upward direction, c) the head having a club shaft-receiving tube that extends within the shell interior and integrally connected with said dished wall extent, d) said bottom wall also having a downward facing medial ridge which extends generally forwardly, said dished wall extent including two dished extents each defining a portion of said inclined surface means whereby upward lift forces are developed at opposite sides of said ridge, e) said dished extents defining shallow recesses.

2. The club head of claim 1 wherein said medial ridge increases in width toward said front wall.

3. The club head of claim 1 wherein said bottom wall has a locally flattened, rearwardly divergent surface that extends at a rearwardly and upwardly extending angle, beyond rearward extent of said ridge, and between rearward extents of said recesses.

4. The club head of claim 3 wherein said bottom wall includes a sole plate peripherally connected to a shell rim defining a bottom opening, said sole plate defining major extents of said shallow recesses, said sole plate also defining said ridge and said locally flattened, rearwardly divergent surface.

5. The club head of claim 1 wherein said recesses are everywhere spaced rearwardly from said front wall.

6. The club head of claim 5 wherein said recesses have surfaces that merge with opposite sides of said ridge.

7. The club head of claim 5 wherein said bottom wall has upwardly facing convex surfaces above said recesses.

8. The club head of claim 7 wherein said downwardly facing surface means includes downward facing surfaces that are concave between the heel and toe.

9. The club head of claim 1 wherein said bottom wall is in part defined by a sole plate having a peripheral edge rigidly connected to the bounding edge of an opening defined by said bottom wall, whereby the sole plate closes said opening, said ridge and recesses being in part defined by the sole plate.

10. The club head of claim 1 wherein said front wall has a U-shaped, lower periphery in a direction between toe and heel, said U-shaped lower periphery spaced forwardly from said recesses.

11. The club head of claim 1 wherein said tube is a substantially continuous, hollow, metallic tube extending within the shell proximate the heel portion and from proximate the shell top wall to the shell bottom wall at a strengthened part of said bottom wall, said tube having a bore to receive the club shaft, said bore intersecting said one shallow recess.

12. The club head of claim 1 wherein said bottom wall includes a sole plate peripherally connected to a shell rim defining a bottom opening, said sole plate defining major extents of said shallow recesses.

13. The club head of claim 1 including a first group of narrow, metallic, shock wave distributing dendrites extending from said front wall generally rearwardly adjacent the underside of the shell top wall and integral therewith, said dendrites projecting toward said two shallow recesses.

14. The club head of claim 13 including a second group of dendrites integral with said top wall and which are spaced apart, and which extend generally rearwardly to merge rearwardly and downwardly with a rear wall defined by the shell to transfer rearward loading to that wall as the dendrites pick up rearward loading from said top wall in response to front wall impact with a golf ball, said second group of dendrites also projecting toward said two shallow recesses.

15. The club head of claim 14 wherein the dendrites of each group are spaced apart in a toe-to-heel direction.

16. A club head of claim 1 wherein the ridge is downwardly convex rearwardly of said front wall and coacts with said recesses during a club stroke to repel the turf toward and into the recesses, the recesses having surfaces inclined forwardly and upwardly to be engaged by the turf moving relatively rearwardly, for creating lift forces at opposite sides of the ridge, urging the bottom wall and head in an upward direction.

17. A golf club head comprising a shell having toe and heel portions, a front wall defining a ball-striking face, and top and bottom walls, said bottom wall characterized as having a medial ridge, and as forming two shallow recesses, one recess between the ridge and the heel portion, and the other recess between the ridge and the toe portion, said recesses everywhere spaced rearwardly from said front wall, the recesses having arcuate peripheral edge portions, said head defining a tube extending within the shell to receive a club shaft, the tube integrated with a portion of the bottom wall that forms said one recess to strengthen same, said tube being a substantially continuous, hollow, metallic tube extending within the shell proximate the heel portion and from proximate the shell top wall to the shell bottom wall at a strengthened part of said bottom wall, said tube having a bore to receive the club shaft, said bore intersecting said one shallow recess and wherein said bottom wall includes a sole plate peripherally connected to a shell rim defining a bottom opening, said sole plate defining major extents of said shallow recesses, said shell defining a bottom wall corner plate section integral with said tube, said sole plate also connected to said corner plate section, said corner plate section forming a portion of said one shallow recess between said ridge and heel portion.

18. In the method of forming a golf club head having a shell and defining top, bottom, front, rear, toe and heel walls, and a shell interior, the steps that include:

a) forming the bottom wall to have upwardly dished wall extent, b) forming said upwardly dished wall extent to have downwardly facing surface means inclined forwardly and upwardly relative to the head swing path as the bottom wall engages the turf, so that the turf moving relatively rearwardly engages said inclined surface means for creating lift force acting to urge the bottom wall and the head in an upward direction, c) and forming the head to have a club shaft-receiving tube that extends within the shell interior to intersect and strengthen said dished wall extent, d) said bottom wall also being formed to have a downward facing medial ridge which extends generally forwardly, said dished wall extent formed to include two dished extents defining a portion of said inclined surface means whereby upward lift forces are developed at opposite sides of said ridge.

19. The method of claim 18 including forming said bottom wall at the same time as the top, front, rear, toe, and heel walls are formed, to be integral therewith.

20. In a golf club, of the type including a head and a shaft with a first end, a portion of the shaft proximate said first end being attached to a head, the head comprising a hollow metal shell having a ball striking front wall having a striking surface, a top portion, a bottom portion, a toe portion, and a heel wall furthest from said toe portion, said top portion being continuous from said toe portion to said heel portion and not extending above an uppermost level established by the top portion centrally of and above an uppermost extent of the ball striking front wall, the improvement comprising:

a) a substantially continuous hollow, metallic tube extending lengthwise along a shell wall from the shell top portion to the shell bottom portion, said tube being integral with and terminating at said metal shell top portion and having a bore, b) the tube bore receiving the shaft, the first end of the shaft being configured to lie proximate the bottom surface of the shell bottom portion, c) there being means connecting the shaft periphery to the tube bore, and the tube bore having an upper end terminating at a level below the level of said uppermost extent of said ball striking front wall, d) and the tube having a lengthwise extending wall integrated along its length with said shell wall so that the shell supports the tube along its length, and whereby metal otherwise required for the tube is used in the shell at locations between the tube and said toe portion, e) said bottom portion of the shell defining a downwardly facing medial ridge, and surfaces at opposite sides of said ridge, one surface extending toward the toe portion and the other surface extending toward the heel wall, said surfaces spaced above the lowermost level of said ridge, f) said tube bore extending downwardly toward said other surface.

21. The improvement of claim 20 wherein said bore intersects said other surface.

22. The improvement of claim 21 wherein at least one of said surfaces is upwardly dished.

23. The improvement of claim 21 wherein said one surface is upwardly dished, and said other surface is upwardly dished.

24. The improvement of claim 23 wherein said one surface has an upwardly dished zone defining a periphery which is convex toward said medial ridge.

25. The improvement of claim 24 wherein said other surface has an upwardly dished zone defining a periphery which is convex toward said medial ridge.

26. The improvement of claim 25 wherein said periphery of said dished zone of said one surface is convex toward said toe region.

27. The improvement of claim 26 wherein said periphery of said dished zone of said other surface is convex toward said heel wall.

28. In the method of forming a golf club head having a shell and defining top, bottom, front rear, toe and heel walls, and a shell interior, the steps that include:

a) forming the bottom wall to have upwardly dished wall extent, b) forming said upwardly dished wall extent to have downwardly facing surface means inclined forwardly and upwardly relative to the head swing path as the bottom wall engages the turf, so that the turf moving relatively rearwardly engages said inclined surface means for creating lift force acting to urge the bottom wall and the head in an upward direction, c) and forming the head to have a club shaft-receiving tube that extends in proximity with the shell to strengthen said shell including said dished wall extent, d) said bottom wall also being formed to have a downward facing medial ridge which extends generally forwardly, said dished wall extent formed to include two dished extents defining portions of said inclined surface means at opposite sides of the ridge whereby upward lift forces are developed at opposite sides of said ridge.

* * * * *